US008136171B2

(12) United States Patent
Huang

(10) Patent No.: US 8,136,171 B2
(45) Date of Patent: Mar. 20, 2012

(54) AUTOMATIC TOILET CLEANING DEVICE

(76) Inventor: Hai-Sheng Huang, Longtan Township, Taoyuan County (TW)

( * ) Notice: Subject to any disclaimer, the term of this patent is extended or adjusted under 35 U.S.C. 154(b) by 310 days.

(21) Appl. No.: 12/626,151

(22) Filed: Nov. 25, 2009

(65) Prior Publication Data

US 2010/0257662 A1 Oct. 14, 2010

(30) Foreign Application Priority Data

Apr. 14, 2009 (TW) ..... 98112281 A
Sep. 29, 2009 (CN) ..... 2009 1 0192815

(51) Int. Cl.
*A47K 13/00* (2006.01)

(52) U.S. Cl. ..... 4/233

(58) Field of Classification Search ..... 4/222, 233
See application file for complete search history.

(56) References Cited

U.S. PATENT DOCUMENTS 4,713,845 A * 12/1987 Bono ..... 4/233
4,734,942 A * 4/1988 Blanchard ..... 4/233
6,289,526 B1 * 9/2001 Chang ..... 4/233

* cited by examiner

*Primary Examiner* — Huyen Le
(74) *Attorney, Agent, or Firm* — Muncy, Geissler, Olds & Lowe, PLLC

(57) ABSTRACT

The present invention discloses an automatic toilet cleaning device. A toilet seat is provided above a bowl and includes a toilet lid and a seat plate. By a means of infrared induction, the toilet lid can be opened automatically when a user is approaching and can be closed automatically after using the toilet. Furthermore, a seat plate cleaning unit provided on the toilet lid can be used to automatically clean the seat plate and an inner rim of the toilet. Therefore, in addition to preventing the user from manually touching the toilet, the present invention can also keep the seat plate and the toilet at the cleanest state at any time.

13 Claims, 10 Drawing Sheets

AUTOMATIC TOILET CLEANING DEVICE

BACKGROUND OF THE INVENTION a) Field of the Invention

The present invention relates to an automatic toilet cleaning device, and more particularly to a device which is able to wash clean a toilet seat plate and the toilet automatically.

b) Description of the Prior Art

An ordinary toilet structure is composed of a toilet body and a toilet seat, wherein the toilet body is provided with a bowl and a water tank which spouts water to the bowl. Under an ideal condition of use, dirt in the bowl can be flushed out through the water spouting function of the water tank to keep clean an interior of the bowl. The toilet seat, on the other hand, is provided above the bowl and includes a toilet lid and a seat plate, wherein a user can sit on the bowl by the seat plate when he or she uses the toilet and the toilet lid can be covered on the bowl when the toilet is not used, to keep a toilet room clean and pretty.

However, the toilet seat plate or peripheries of the bowl can be usually stained by splashing or an inappropriate use when the toilet is used. This condition occurs particularly easily in a public place and toilets in the public place can not only get dirty easily but easily become a propagation platform of germs. As a result, many people will carry a great psychological pressure when using the toilets in the public place or will be even forced to use the toilets by squatting or with a gesture like playing an acrobatics, with a purpose of reducing a chance of directly contacting the toilets and ambient environment thereof.

On the other hand, it will become a rather annoying issue when one is forced to lift the toilet lid or the seat plate first before using the toilet in the public place. Accordingly, a toilet seat which can automatically wash clean the seat plate and the toilet is developed by the present inventor, allowing the toilet to be used cleanlier, more hygienically, conveniently and comfortably.

SUMMARY OF THE INVENTION

The primary object of the present invention is to provide an automatic toilet cleaning device to solve the issue that the user needs to lift the toilet lid and the seat plate manually and to keep the toilet seat plate clean at any time.

To achieve the aforementioned object, the automatic toilet cleaning device of the present invention includes a seat plate which is pivoted at an upper rim of a bowl, a toilet lid which is pivoted and covered at the upper rim of the bowl to cover the seat plate, a toilet lid open-close unit which is connected to the toilet lid to control an open-close state of the toilet lid, a seat plate cleaning unit which is provided on the toilet lid, and a control unit which is provided close to the bowl. When implementing, the toilet seat is further provided with a flushing unit which is disposed at the upper rim of the bowl to clean skin between buttocks of the user, an operating interface of the flushing unit being integrated on the aforementioned control unit.

The said toilet lid open-close unit is provided with a water feed end to fetch a water source, an air port end to connect a pneumatic device, and a cleaning head which is connected to the aforementioned water feed end and the air port end and can encircle along an outline of the seat plate. The control unit is provided with at least one infrared inductive switch. When the infrared inductive switch detects that the user is approaching, the control unit will activate the toilet lid open-close unit to open the toilet lid automatically. Whereas, when the infrared inductive switch detects that the user has left, the control unit will drive the toilet lid to be closed and activate the seat plate cleaning unit after the toilet lid has been closed, allowing the cleaning head to encircle and spray the seat plate, followed by enabling the cleaning head to air dry the seat plate, thereby achieving the object of automatically cleaning the seat plate.

The said toilet lid open-close unit includes a first motor gear assembly to drive the toilet lid pivoting. The seat plate cleaning unit includes a guiding rail which surrounds a lower rim of the toilet lid, a concealed conduit which is buried in the toilet lid to connect the water feed end and the air port end, a rotation connector which is connected with the concealed conduit, an open conduit which is connected with the rotation connector and is exposed at the lower rim of the toilet lid, an extension tube which is inserted at an end of the open conduit to mount the cleaning head at a tail end, a spring which is sheathed at an exterior of the extension tube, a pulley unit which is provided at a tail end of the cleaning head to fit with the guiding rail, and a second motor gear assembly which is buried in the toilet lid to drive the open conduit rotating and is electrically connected to the aforementioned control unit. When the second motor gear assembly drives the open conduit rotating, through guiding of the guiding rail and extension of the spring, an extension length of the extension tube can be changed following a change of span of the guiding rail.

Another object of the present invention is to provide the automatic toilet cleaning device, wherein a second cleaning head is provided and is pivoted at a side end of the cleaning head, such that the second cleaning head can swing and pivot relative to the cleaning head and wash simultaneously inner peripheries of the bowl along with a displacement of the cleaning head, thereby flushing clean the inner peripheries of the bowl where dirt is easily accumulated.

At a same time when the cleaning head is carrying out the cleaning operation, the second cleaning head is suspended along with natural down-swing of the cleaning head. The second cleaning head is provided with a second linear water injection nozzle which injects cleaning water to flush the inner peripheries of the bowl simultaneously. Furthermore, the cleaning head is provided with a bypass assembly which is connected between a water injection chamber and the second cleaning head, allowing the water injection chamber to supply water to the second cleaning head. Besides, the cleaning head is disposed with a movement stop button to restrict a down-swing angle of the second cleaning head. The movement stop button is pushed by a hydraulic pressure to be protruded, thereby restricting the down-swing angle of the second cleaning head.

In comparison to the prior art, the present invention is at least provided with following features and advantages:

1. The infrared induction technology is used to detect the approaching user, allowing the toilet lid to be opened automatically. This can solve the annoying problem of the conventional toilet that the toile lid has to be lifted manually by the user.
2. The infrared induction technology is used to detect that the user has left, allowing the toilet lid to be closed automatically and automatically activating the seat plate cleaning unit, such that the seat plate can be cleaned in time after each use, thereby solving the problem that the seat plate and the bowl can get dirty easily.
3. The toilet lid can cover the upper rim of the bowl and completely cover the seat plate, preventing the cleaning water from sliding off an outer rim of the toilet and splashing and allowing the seat plate to be blown dry or sucked dry quickly when the pneumatic device blows or sucks air, thereby quickly accomplishing cleaning the seat plate and the upper rim of the bowl.

Besides, a rear side of an inner rim of the bowl can be provided with an odor discharge orifice which can be connected externally to a ventilation system of a building or an open outdoor space, thereby improving comfortableness in using the toilet.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
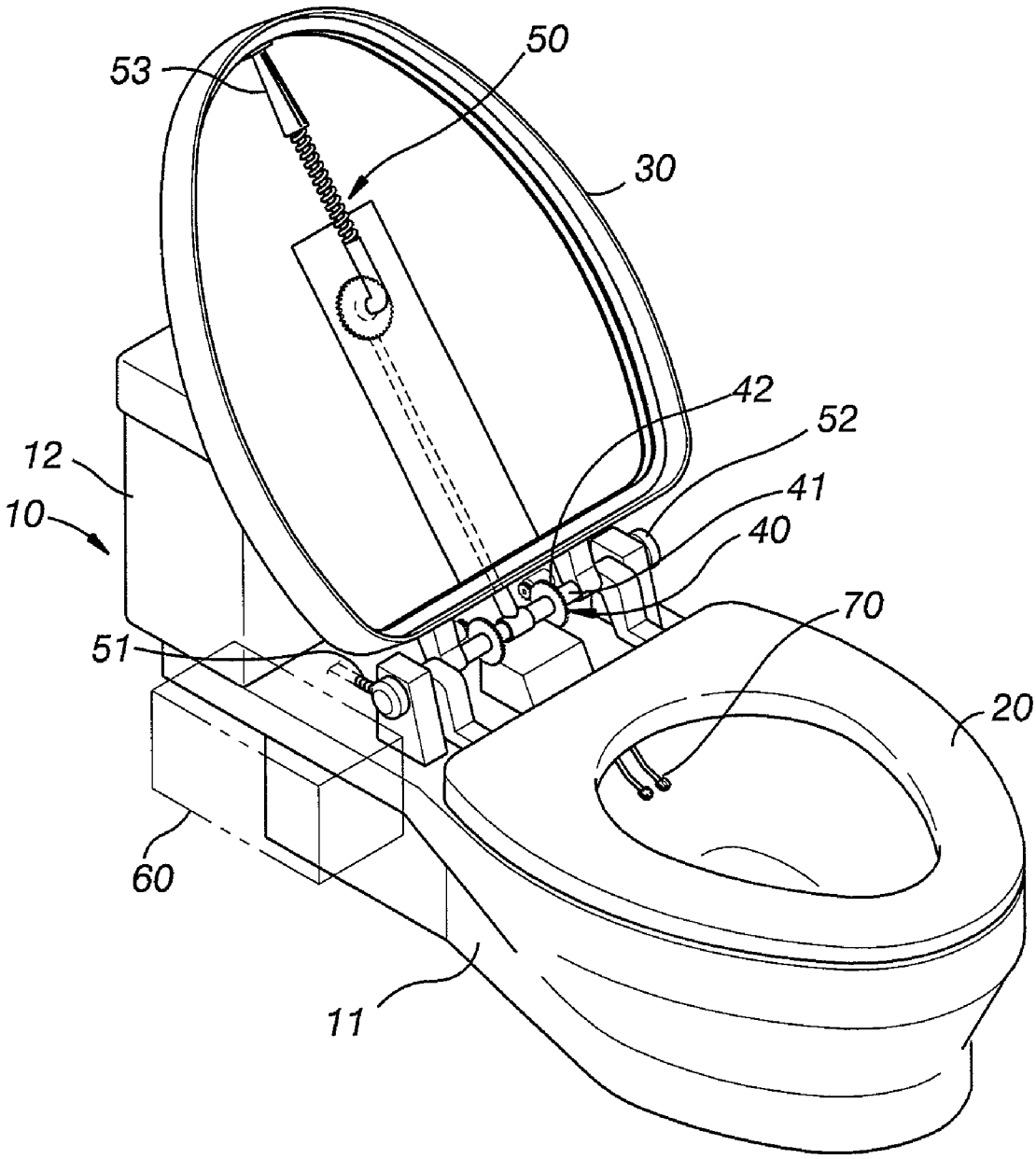
FIG. 1 shows a three-dimensional perspective view of a first embodiment of the present invention.
Figure 2:
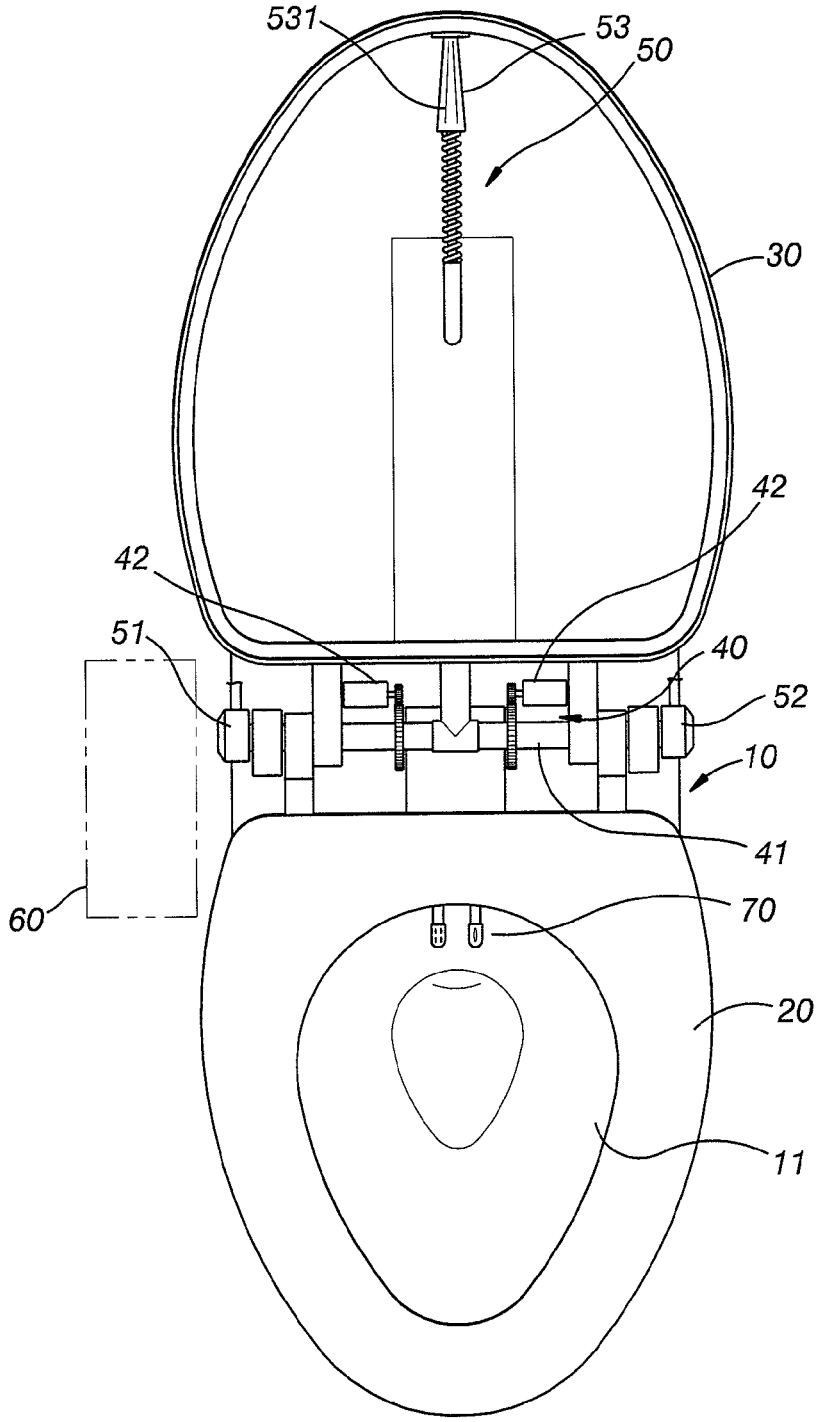
FIG. 2 shows a top view of a first embodiment of the present invention.

Referring to FIG. 1 and FIG. 2, it shows a three-dimensional perspective view and a top view of a first embodiment of the present invention. As shown in the drawings, a toilet seat is provided above a toilet body 10 and comprises a seat plate 20, a toilet lid 30, a toilet lid open-close unit 40, a seat plate cleaning unit 50, a control unit 60 and a flushing unit 70. The toilet body 10 is provided with a bowl 11 and a water tank 12 which supplies water to the bowl 11.

The seat plate 20 is pivoted at an upper rim of the bowl 11, and the toilet lid 30 is pivoted at the upper rim of the bowl 11 to completely cover the seat plate 20 when covering.

The toilet lid open-close unit 40 is connected to the toilet lid 30 to control an open-close state of the toilet lid 30. The toilet open-close unit 40 includes a hollow pivot 41 which is connected to the toilet lid 30, at least one set of first motor gear assembly 42 which is connected to the hollow pivot 41 to drive the toilet lid 30 pivoting.

The seat plate cleaning unit 50 is provided on the toilet lid 30 and is provided with a water feed end 51 (co-constructed with the aforementioned hollow pivot 41) to fetch a water source, an air port end 52 (co-constructed with the aforementioned hollow pivot 41) to connect a pneumatic device, and a cleaning head 53 which is connected to the aforementioned water feed end 51 and the air port end 52 to encircle along an outline of the seat plate 20. The cleaning head 53 is provided with at least one linear opening 531 corresponding to the seat plate 20 and two linear openings 531 are provided in the drawings for description.

The control unit 60 is provided close to the bowl 11 and is provided with at least one infrared inductive switch. A solenoid valve which controls water supply of the water feed end 51 and the pneumatic device which feeds and discharges air at the air port end 52 are connected at the control unit 60.

When the infrared inductive switch detects that a user is approaching, the control unit 60 will activate the toilet lid open-close unit 40 to open the toilet lid 30 automatically; whereas, when the infrared inductive switch detects that the user has left, the control unit 60 will activate the toilet lid open-close unit 40 to close the toilet lid 30 and activate the seat plate cleaning unit 50 after the toilet lid 30 has been closed, allowing the cleaning head 53 to encircle and spray the seat plate 20, followed by enabling the cleaning head 53 to encircle and air dry the seat plate 20 (blowing or sucking air), thereby achieving the object of automatically cleaning the seat plate 20. In addition, a spout operation of the water tank 12 is controlled by a solenoid valve which is electrically connected with the control unit 60, allowing the water tank 12 to spout water automatically when the infrared inductive switch detects that the user has left.

The flushing unit 70 is provided at the upper rim of the bowl 11 to clean skin between buttocks of the user. An operating interface of the flushing unit 70 is integrated on the aforementioned control unit 60, facilitating the user to operate and control.

Figure 3:
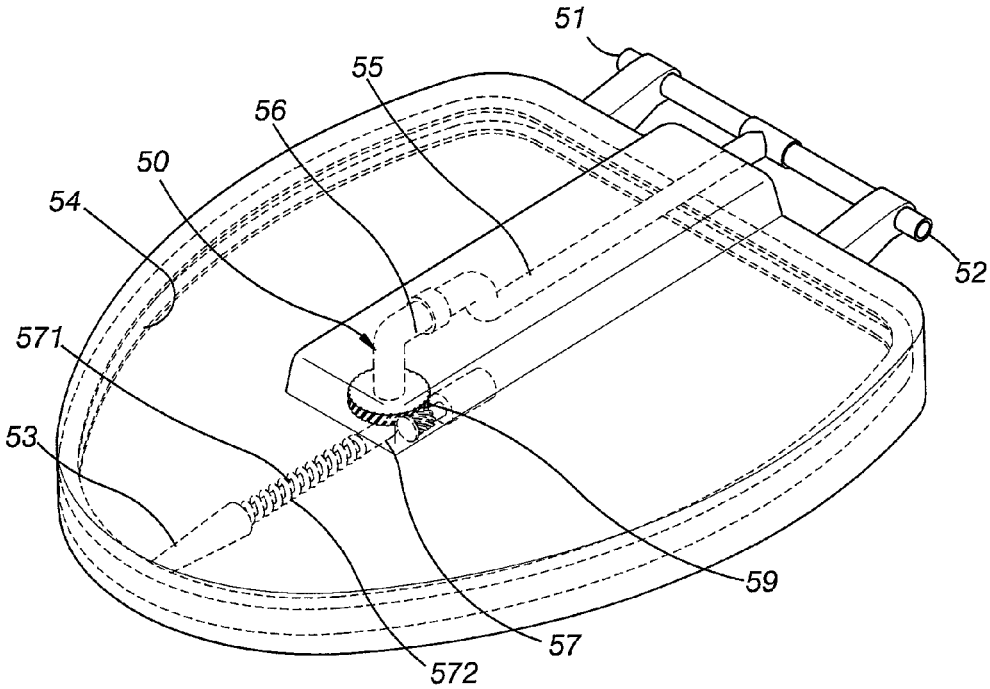
FIG. 3 shows a schematic view of a position where a seat plate cleaning unit is provided, according to a first embodiment of the present invention.
Figure 4:
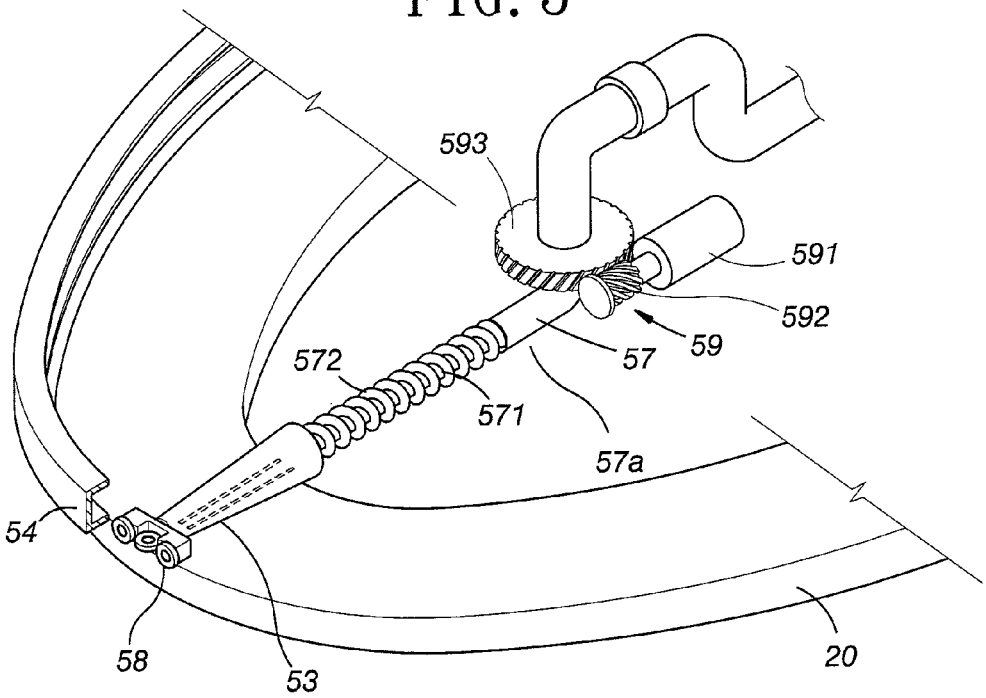
FIG. 4 shows a three-dimensional perspective view of a seat plate cleaning unit, according to a first embodiment of the present invention.
Figure 5:
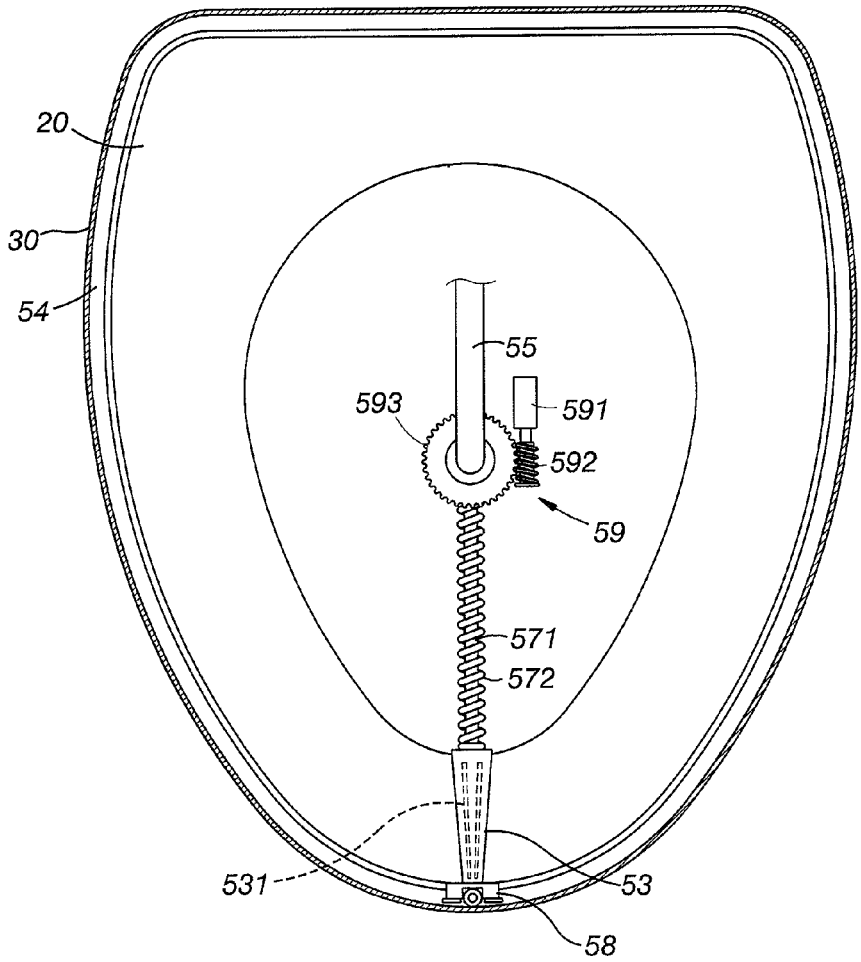
FIG. 5 shows a top view of a seat plate cleaning unit, according to a first embodiment of the present invention.

Referring to FIGS. 3 to 5, it shows a schematic view of a position where a seat plate cleaning unit is provided, a three-dimensional perspective view of a seat plate cleaning unit and a top view of a seat plate cleaning unit, according to a first embodiment of the present invention. The detail structure of the seat plate cleaning unit 50 disclosed in the drawings further includes a guiding rail 54 which surrounds at a lower rim of the toilet lid 30, a concealed conduit 55 which is buried in the toilet lid 30 to connect the water feed end 51 and the air port end 52, a rotation connector 56 which is connected with the concealed conduit 55, an open conduit 57 which is connected at the rotation connector 56 and is exposed at the lower rim of the toilet lid 30, an extension tube 571 which is inserted at an end of the open conduit 57 to mount the cleaning head 53 at a tail end, a spring 572 which is sheathed at an exterior of the extension tube 571, a pulley unit 58 which is provided at a tail end of the cleaning head 53 to fit with the guiding rail 54, and a second motor gear assembly 59 which is buried in the toilet lid 30 to drive the open conduit 57 rotating. The second motor gear assembly 59 is electrically connected at the aforementioned control unit 60 and is provided with at least a motor 591, a worm shaft 592 and a transmission gear 593; whereas the pulley unit 58 disclosed in the present embodiment is constituted by plural pulleys.

Figure 6:
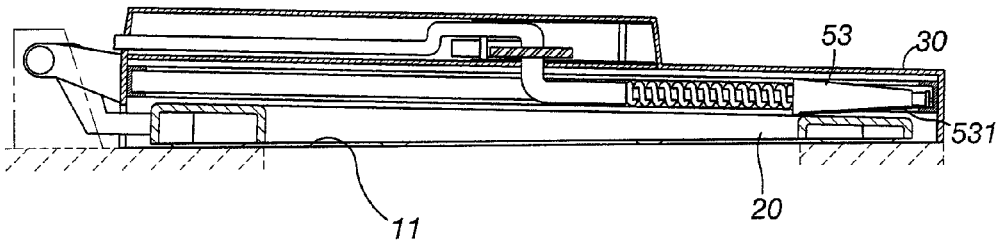
FIG. 6 shows a local cutaway view of a first embodiment of the present invention.

Referring to FIG. 6, it shows a local cutaway view of a first embodiment of the present invention. When the toilet lid 30 is covered at the upper rim of the bowl 11, the entire upper rim of the bowl 11 will be shielded and the entire seat plate 20 will be covered completely. Therefore, when water is sprayed, air is blown or sucked at the linear opening 531 at a bottom end of the cleaning head 53, cleaning water can be prevented from leaking out of the toilet.

Figure 7:
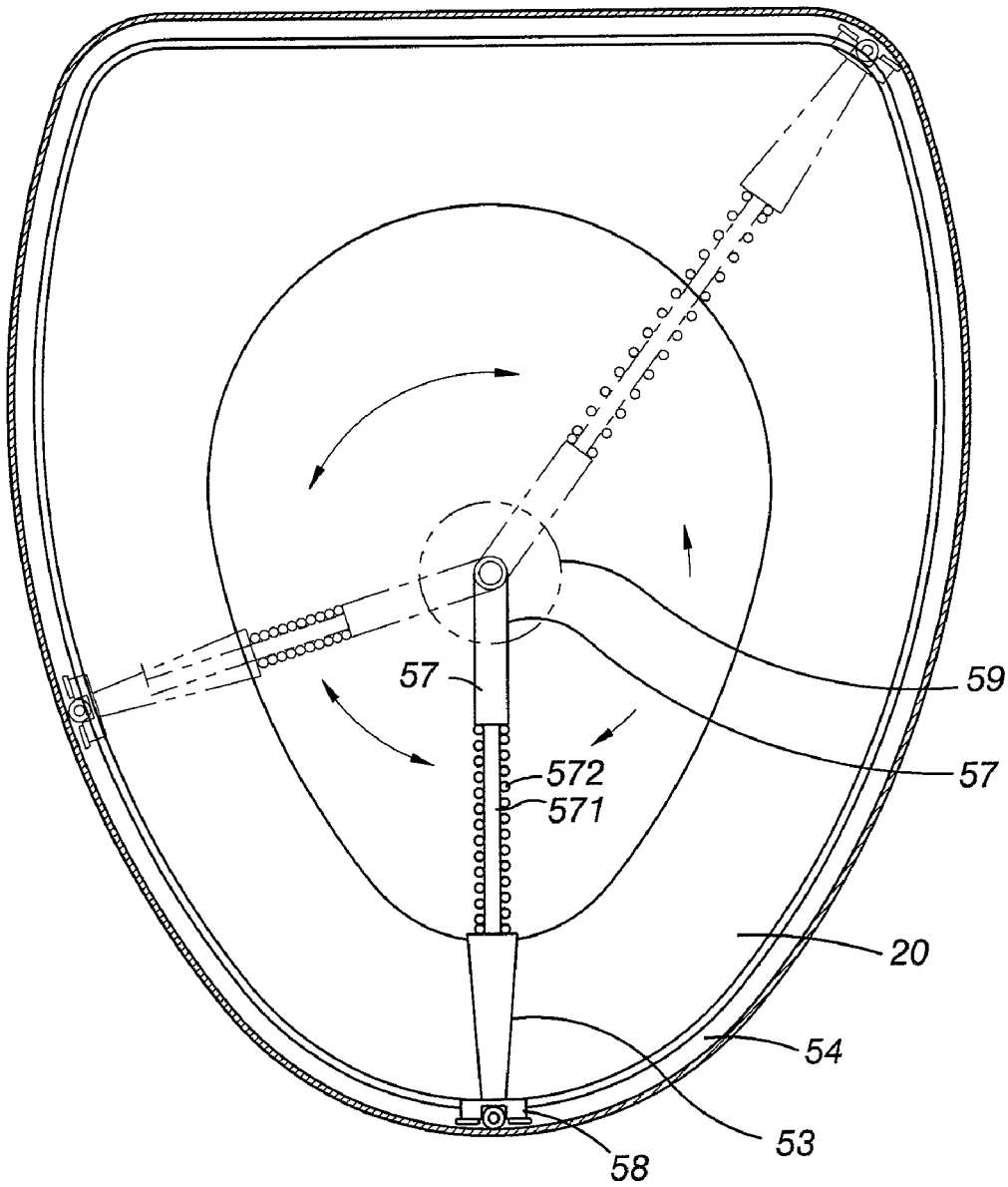
FIG. 7 shows a schematic view of an encircling operation of a seat plate cleaning unit, according to a first embodiment of the present invention.

Referring to FIG. 7, it shows a schematic view of an encircling operation of a seat plate cleaning unit, according to a first embodiment of the present invention. When the second motor gear assembly 59 drives the open conduit 57 rotating, an extension length of the extension tube 571 can be changed through guiding of the guiding rail 54 and an extension function of the spring 572, following a change of span of the guiding rail 54, allowing the cleaning head 53 to encircle along the seat plate 20 to carry out the cleaning operation.

Figure 8:
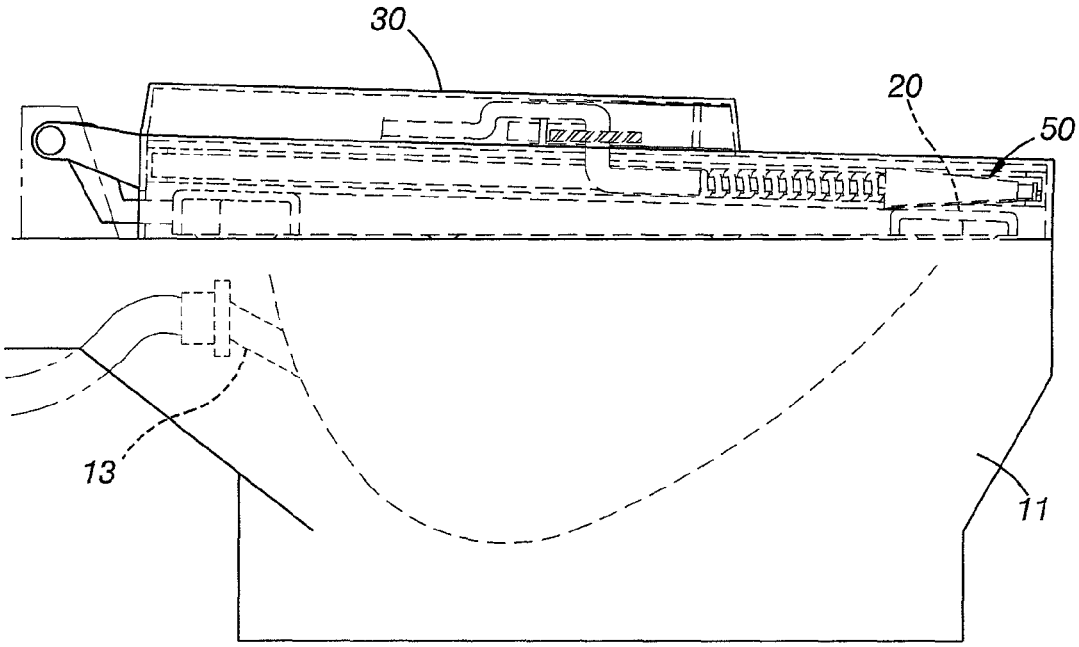
FIG. 8 shows a schematic view of a bowl which is provided with an odor discharge orifice, according to a first embodiment of the present invention.

Referring to FIG. 8, it shows a schematic view of a bowl which is provided with an odor discharge orifice, according to a first embodiment of the present invention. As it is inevitable to result in unbearable odor when using the toilet, upon implementing the present invention, a rear side of an inner rim of the bowl 11 can be provided with an odor discharge orifice 13, a rear end of which can be connected externally to a ventilation system of a building or an open outdoor space wherein a natural chimney effect or a means of installing a powerless windmill can be employed to improve the discharge effect.

Figure 9:
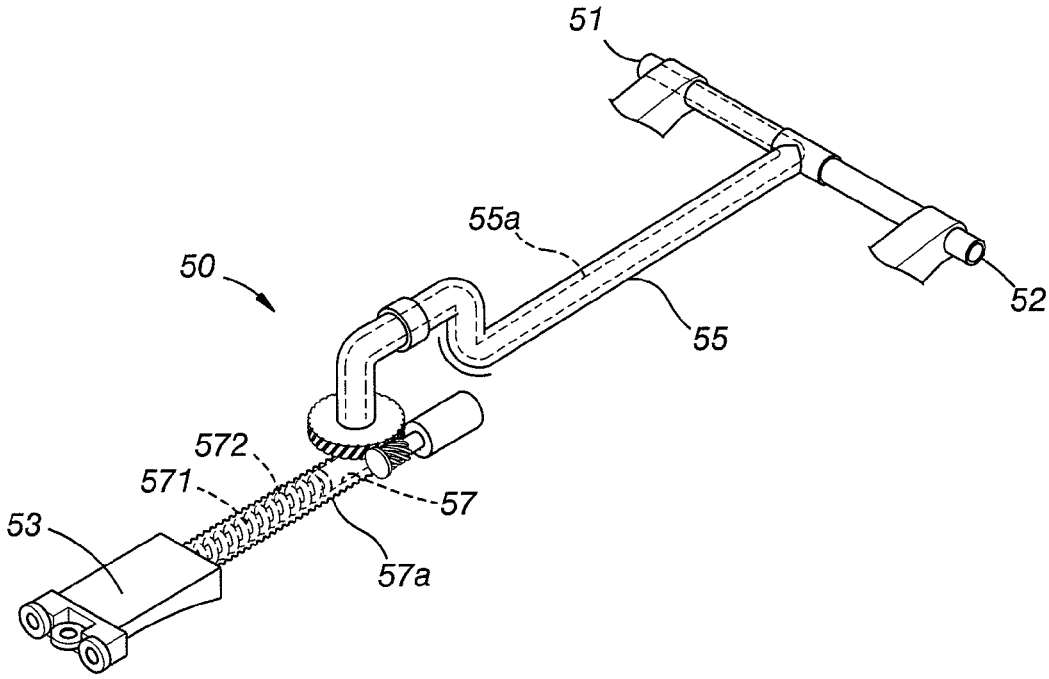
FIG. 9 shows a schematic view of a seat plate cleaning unit of a second embodiment of the present invention.
Figure 10:
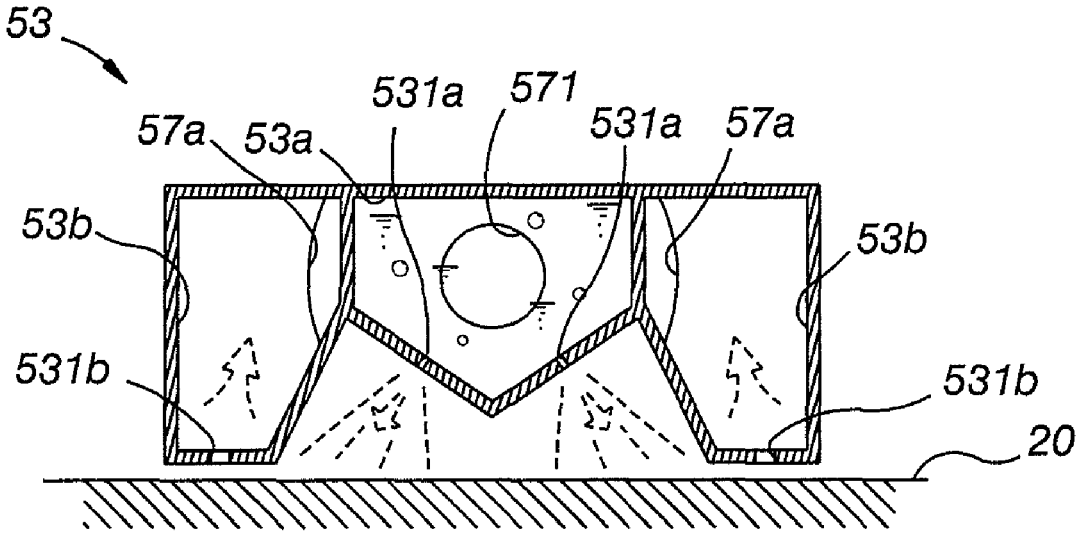
FIG. 10 shows a cutaway view of a cleaning head of a second embodiment of the present invention.

Referring to FIG. 9 and FIG. 10, it shows a schematic view of a seat plate cleaning unit and a cutaway view of a cleaning head, according to a second embodiment of the present invention. The second embodiment provides a technological means by which water supply and sucking dry can be conducted simultaneously. The difference of the seat plate cleaning unit 50 disclosed by the present embodiment from that disclosed by the first embodiment lies in that an interior of the concealed conduit 55 is transfixed with an inner concealed conduit 55*a*, wherein the inner concealed conduit 55*a* is connected with the water feed end 51 and a holding space formed between peripheries of the inner concealed conduit 55*a* and an inner wall of the concealed conduit 55 is connected with the air port end 52.

The open conduit 57 and the extension tube 571 are connected with the aforementioned inner concealed conduit 55*a*, allowing cleaning water to flow through. Exterior sides of the open conduit 57, the extension tube 571 and the spring 572 are sheathed with an extensible outer open conduit 57*a* and a holding space formed between the outer open conduit 57*a* and the open conduit 57, the extension tube 571 and the spring 572 is connected with the concealed conduit 55, allowing high pressure gas to flow through.

As shown in FIG. 10, the cleaning head 53 of the second embodiment of the present invention includes a water injection chamber 53*a* which is connected with the extension tube 571 and two air suction chambers 53*b* which are provided respectively at two sides of the water injection chamber 53*a* to connect the outer open conduit 57*a*.

A bottom end of the water injection chamber 53*a* is provided with at least one linear water injection nozzle 531*a* toward the seat plate 20 (two nozzles in the drawing), and there are at least one linear air suction port 531*b* respectively at bottom ends of air suction chambers 53*b* at two sides, toward the seat plate 20. An aperture of the linear water injection nozzle 531*a* is smaller than that of the linear air suction port 531*b* and a proper spray distance is kept between the linear water injection nozzle 531*a* and the seat plate 20; whereas, the linear air suction port 531*b* keeps at a closer distance to the seat plate 20.

When performing the cleaning operation, the linear water injection nozzle 531*a* will inject water to the seat plate 20 for cleaning. At this time, the linear air suction ports 531*b* at two sides can suck air simultaneously, thereby sucking dry the cleaning water at a same time. Thus, the seat plate 20 and the peripheries of the seat plate 20 can manifest a dry configuration after cleaning, and the cleaning water will not be easily sprayed onto the seat plate 20.

Figure 11:
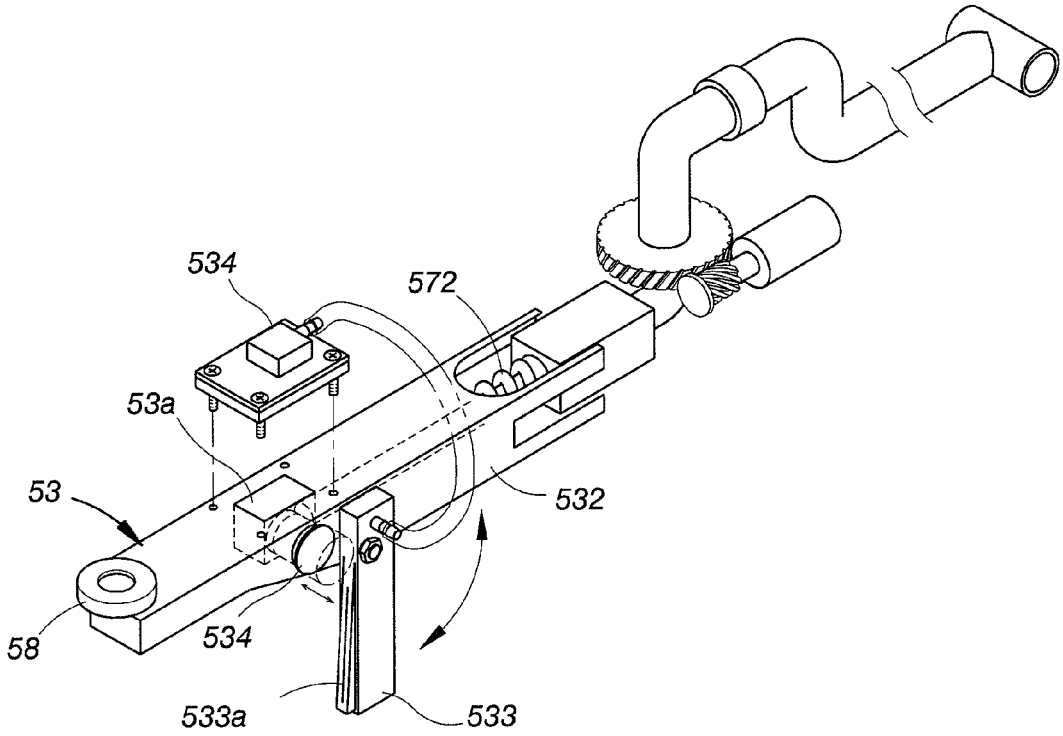
FIG. 11 shows a schematic view of a cleaning head of a third embodiment of the present invention.
Figure 12:
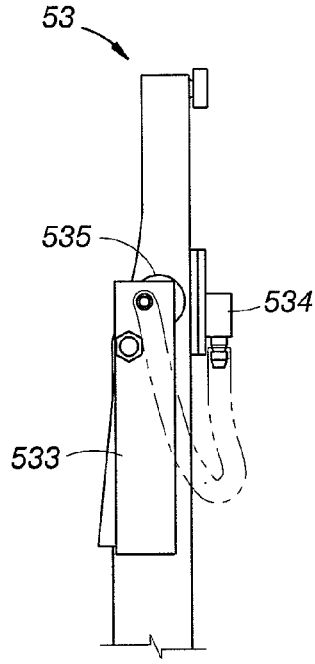
FIG. 12 shows a schematic view of a cleaning head, which is not operating, of a third embodiment of the present invention.
Figure 13:
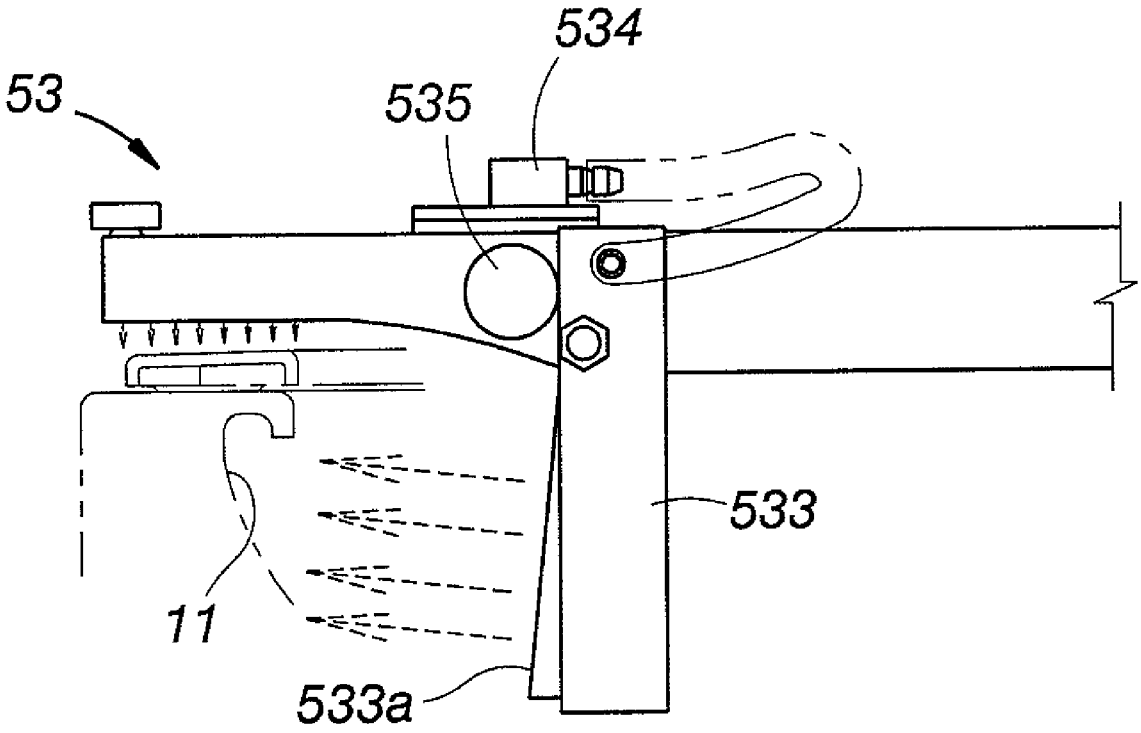
FIG. 13 shows a schematic view of an operation of a cleaning head of a third embodiment of the present invention.

Referring to FIGS. 11 to 13, it shows a schematic view of a cleaning head, a schematic view of a cleaning head which is not operating and a schematic view of an operation of a cleaning head, according to a third embodiment of the present invention. The cleaning head of the present embodiment is an altered implementation derived from the second embodiment. A rear end of the cleaning head 53 is extended with a shelter 532 to shield the spring 572 and a side end of the cleaning head 53 is pivoted with a second cleaning head 533 which can swing and pivot relative to the cleaning head 53. In addition, the cleaning head 53 is provided with a bypass assembly 534 which is connected between the water injection chamber 53*a* and the second cleaning head 533, allowing the water injection chamber 53*a* to supply water to the second cleaning head 533. The second cleaning head 533 is provided with a second linear water injection nozzle 533*a*, and the pulley unit 58 described in the present embodiment is formed by a single pulley.

At a same time when the cleaning head 53 swings downward to a horizontal state to perform the cleaning operation, the second cleaning head 533 will swing downward naturally to manifest a suspension state. At this time, the cleaning water that is injected from the second linear water injection nozzle 533*a* can result in a wider cleaning angle and wash simultaneously the peripheries of the inner side of the bowl 11, along with the displacement of the cleaning head 53. Therefore, the locations of the inner peripheries of the bowl 11, close to an upper side where dirt is easily accumulated, can be flushed clean.

On the other hand, the cleaning head 53 is provided with a movement stop button 535 which is used to restrict a down-swing angle of the second cleaning head 533. The movement stop button 535 penetrates the cleaning head 53 and enters into the water injection chamber 53*a*. When a water flow is filled into the water injection chamber 53*a*, the movement stop button 533 can be pushed by a hydraulic pressure to be protruded, thereby restricting the down-swing angle of the second cleaning head 533.

Accordingly, when the user approaches the toilet, the toilet lid 30 will be opened automatically and the odor generated when the toilet is being used will be removed immediately from the odor discharge orifice 13. On the other hand, when the user leaves, the toilet lid 30 will be closed automatically and the seat plate 20 will be washed clean and air dried immediately by the seat plate cleaning unit 50. As a result, the comfortableness in using the toilet is improved significantly, allowing the toilet to be used cleanlier and more hygienically.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. An automatic toilet cleaning device being provided above a toilet body which includes a bowl and a water tank to supply water to the bowl, the said toilet comprising:

a seat plate which is pivoted at an upper rim of the bowl;

a toilet lid which is pivoted at and covered on the upper rim of the bowl to cover the seat plate;

a toilet lid open-close unit which is connected to the toilet lid to control an open-close state of the toilet lid;

a seat plate cleaning unit which is provided on the toilet lid and is provided with a water feed end to fetch a water source, an air port end to connect a pneumatic device and a cleaning head being connected to the water feed end and the air port end to encircle along an outline of the seat plate; and a control unit which is provided close to the bowl, activating the seat plate cleaning unit after the toilet lid has been closed, enabling the cleaning head to encircle and spray the seat plate, followed by allowing the cleaning head to encircle and air dry the seat plate, thereby achieving an object of automatically cleaning the seat plate.

2. The automatic toilet cleaning device according to claim 1, wherein the cleaning head is provided with at least one linear opening.

3. The automatic toilet cleaning device according to claim 1, wherein the control unit further includes an infrared inductive switch; when the infrared inductive switch detects that a user is approaching, the control unit activating the toilet lid open-close unit to open the toilet lid automatically, whereas, when the infrared inductive switch detects that the user has left, the control unit activating the toilet lid open-close unit to close the toilet lid automatically.

4. The automatic toilet cleaning device according to claim 1, further including a flushing unit which is provided at an upper rim of the bowl to clean skin between buttocks of a user, an operating interface of the flushing unit being integrated on the control unit.

5. The automatic toilet cleaning device according to claim 1, wherein a rear side of an inner rim of the bowl is provided with an odor discharge orifice.

6. The automatic toilet cleaning device according to claim 1, wherein the toilet lid open-close unit includes a first motor gear assembly which is used to drive the toilet lid pivoting.

7. The automatic toilet cleaning device according to claim 1, wherein the cleaning unit includes a guiding rail which surrounds at a lower rim of the toilet lid, a concealed conduit which is buried in the toilet lid to connect the water feed end and the air port end, a rotation connector which is connected with the concealed conduit, an open conduit which is connected at the rotation connector and is exposed at the lower rim of the toilet lid, an extension tube which is inserted at an end of the open conduit to mount the cleaning head at a tail end, a spring which is sheathed at an exterior of the extension tube, a pulley unit which is provided at a tail end of the cleaning head to fit with the guiding rail, and a second motor gear assembly which is buried in the toilet lid to drive the open conduit rotating, the second motor gear assembly being electrically connected to the control unit.

8. The automatic toilet cleaning device according to claim 1, wherein the pneumatic device sucks air at the air port end.

9. The automatic toilet cleaning device according to claim 1, wherein the pneumatic device blows air at the air port end.

10. The automatic toilet cleaning device according to claim 1, wherein a water sprout operation of the water tank is controlled by a solenoid valve which is electrically connected with the control unit and enables the water tank to automatically spout water when the infrared inductive switch detects that a user has left.

11. The automatic toilet cleaning device according to claim 1, wherein the cleaning unit includes a guiding rail which surrounds at a lower rim of the toilet lid; a concealed conduit which is buried in the toilet lid to connect the air port end; an inner concealed conduit which is provided in the concealed conduit to connect with the water feed end; a rotation connector which is connected with the concealed conduit; an open conduit which is connected with the rotation connector to connect the inner concealed conduit; an extension tube which is inserted at an end of the open conduit to mount the cleaning head at a tail end; a spring which is sheathed at an exterior of the extension tube; an extensible outer open conduit which is sheathed at exterior sides of the open conduit, the extension tube and the spring; a pulley unit which is provided at a tail end of the cleaning head to fit with the guiding rail and a second motor gear assembly which is buried in the toilet lid to drive the open conduit rotating, the second motor gear assembly being electrically connected with the control unit; the cleaning head including a water injection chamber which is connected with the extension tube, and two air suction chambers which are provided respectively at two sides of the water injection chamber to connect the outer open conduit; a bottom end of the water injection chamber being provided with at least one linear water injection nozzle toward the seat plate, and bottom ends of the air suction chambers at two sides being provided respectively with at least one linear air suction port toward the seat plate.

12. The automatic toilet cleaning device according to claim 11, wherein a rear end of the cleaning head is extended with a shelter to shield the spring and a side end of the cleaning head is pivoted with a second cleaning head, allowing the second cleaning head to swing and pivot relative to the cleaning head; the cleaning head being provided with a bypass assembly which is connected between the water injection chamber and the second cleaning head, enabling the water injection chamber to supply water to the second cleaning head; the second cleaning head being provided with at least one second linear water injection nozzle; when the cleaning head swings downward to a horizontal state to perform the cleaning operation, the second cleaning head swinging downward naturally to manifest a suspension state.

13. The automatic toilet cleaning device according to claim 12, wherein the cleaning head is provided with a movement stop button which is used to restrict a down-swing angle of the second cleaning head; the movement stop button penetrating the cleaning head and entering into the water injection chamber; when a water flow is filled into the water injection chamber, the movement stop button being pushed by a hydraulic pressure to be protruded, thereby restricting the down-swing angle of the second cleaning head.

* * * * *